US005431308A

United States Patent [19]

Tchen

[11] Patent Number: 5,431,308

[45] Date of Patent: Jul. 11, 1995

[54] APPARATUS FOR STORING AND DISPENSING FLUIDS FOR USE BY AN ATHLETE

[76] Inventor: Jian P. Tchen, 15418 12th Ave. NE., Seattle, Wash. 98155

[21] Appl. No.: 276,866

[22] Filed: Jul. 18, 1994

[51] Int. Cl.[6] ..... B67D 5/64

[52] U.S. Cl. ..... 222/175; 222/529

[58] Field of Search ..... 222/175, 527, 546, 529; 224/148

[56] References Cited

U.S. PATENT DOCUMENTS

| | | | |
|---|---|---|---|
| 4,090,650 | 5/1978 | Gotta | 224/148 |
| 4,139,130 | 2/1979 | Glusker et al. | 222/175 X |
| 4,176,772 | 12/1979 | Danon | 224/148 |
| 4,265,381 | 5/1981 | Muscatell | 224/148 |
| 4,948,023 | 8/1990 | Tripp | 222/175 X |
| 5,085,349 | 2/1992 | Fawcett | 222/175 |
| 5,104,016 | 4/1992 | Runkel | 222/175 X |
| 5,207,362 | 5/1993 | Janus et al. | 222/148 |

*Primary Examiner*—Gregory L. Huson

[57] ABSTRACT

An apparatus for storing and dispensing fluids for use by an athlete comprising an elongated hollow tube formed of a flexible material, the tube having closed ends and a hollow interior along its length; a pair of straps secured to and extending outwardly from the free ends with fasteners at the outboard ends of the straps for coupling therebetween and effecting the creation of a loop of the straps and tube; a flexible, plastic straw having an inboard end in fluid communication with the interior of the tube and having an outboard end with a mouthpiece secured with respect thereto, clips secured to the exterior surface of the tube for removably receiving the straw to hold it in position adjacent to the tube; and an aperture on an upper surface of the tube with a filler plug removably received thereover to allow filling of the interior of the tube with a liquid to be consumed through the straw.

2 Claims, 3 Drawing Sheets

FIG. 1
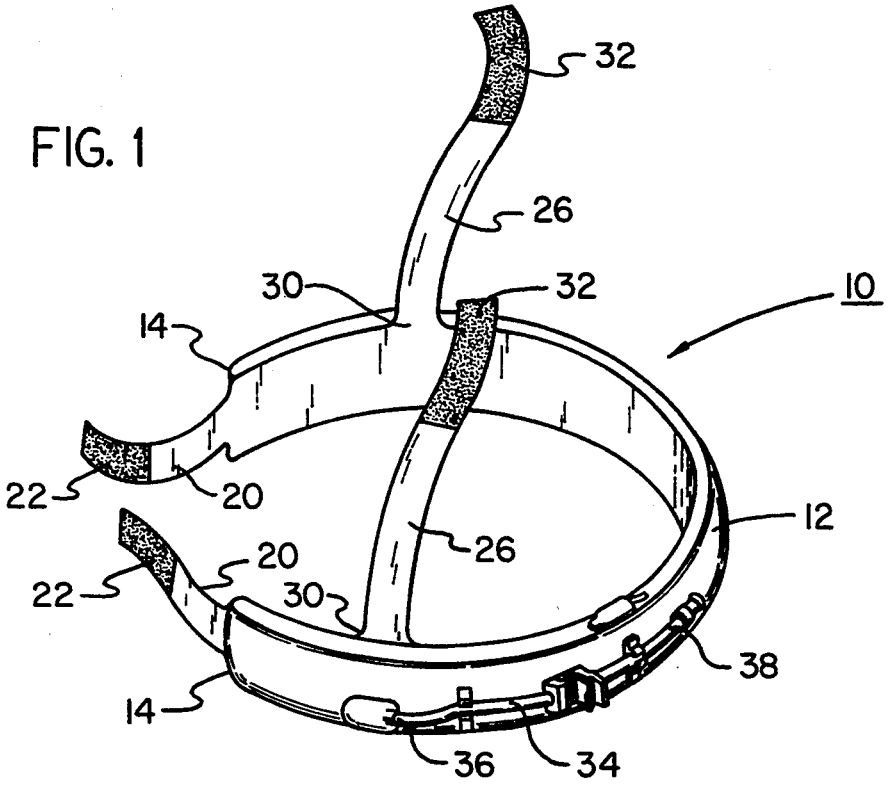
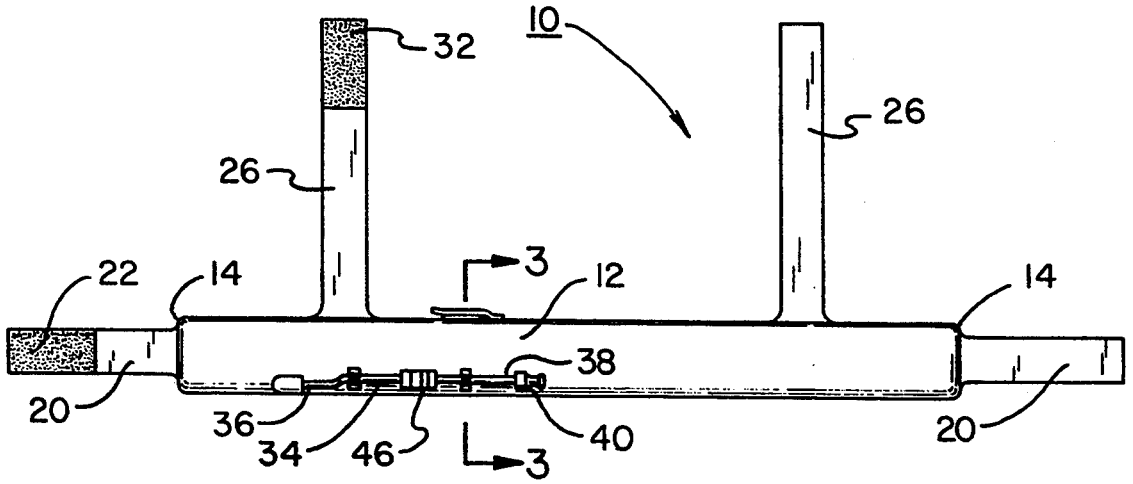
FIG. 2

APPARATUS FOR STORING AND DISPENSING FLUIDS FOR USE BY AN ATHLETE

BACKGROUND OF THE INVENTION

1. Field of the Invention

The present invention relates to apparatus for storing and dispensing fluids for use by an athlete and more particularly pertains to storing a quantity of fluid for use on the person of an athlete and for dispensing such fluid as needed.

2. Description of the Prior Art

The use of devices of a large number of designs and configurations for storing liquid for one purpose or another is known in the prior art. More specifically, devices of a large number of designs and configurations for storing liquid for one purpose or another heretofore devised and utilized for the purpose of storing liquids and dispensing it through devices of various configurations are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,167,354 to Cohanfard a beverage-container and sipping assembly.

U.S. Pat. No. 5,048,705 to Lynd discloses a bottle and drinking tube assembly.

U.S. Pat. No. 4,703,927 to Hanzlik discloses a jogger's hand weight and water bottle for drinking.

U.S. Pat. No. Des. 287,061 to Bound discloses the design of a combined helmet and beverage container supports.

In this respect, the apparatus for storing and dispensing fluids for use by an athlete according to the present invention substantially departs from the conventional concepts and designs of the prior art, and in doing so provides an apparatus primarily developed for the purpose of storing a quantity of fluid for use on the person of an athlete and for dispensing such fluid as needed.

Therefore, it can be appreciated that there exists a continuing need for new and improved apparatus for storing and dispensing fluids for use by an athlete which can be used for storing a quantity of fluid for use on the person of an athlete and for dispensing such fluid as needed. In this regard, the present invention substantially fulfills this need.

SUMMARY OF THE INVENTION

In view of the foregoing disadvantages inherent in the known types of devices of a large number of designs and configurations for storing liquid for one purpose or another now present in the prior art, the present invention provides an improved apparatus for storing and dispensing fluids for use by an athlete. As such, the general purpose of the present invention, which will be described subsequently in greater detail, is to provide a new and improved apparatus for storing and dispensing fluids for use by an athlete and method which has all the advantages of the prior art and none of the disadvantages.

To attain this, the present invention essentially comprises a new and improved apparatus for storing and dispensing fluids for use by an athlete comprising, in combination, an elongated hollow tube formed of a flexible, plastic material, the tube having closed ends and a hollow interior along its length; a pair of straps secured to and extending outwardly from the free ends with pile type fasteners at the outboard ends of the straps for coupling therebetween and effecting the creation of a loop of the straps and tube; a pair of vertical straps each extending upwardly from an interior surface of the tube at diametrically opposed locations with pile type fasteners secured to the upper ends thereof for removable coupling therebetween during the positioning of the device as on the helmet of an athlete; a flexible, plastic straw having an inboard end in fluid communication with the interior of the tube and having an outboard end with a plastic mouthpiece removably secured with respect thereto, clips secured to the exterior surface of the tube for removably receiving the straw to hold it in position adjacent to the tube; an on/off valve positioned at an intermediate location of the straw for sealing the straw to preclude removal of liquid from interior of the tube to and through the mouthpiece; and an aperture on an upper surface of the tube with a filler plug removably received thereover to allow filling of the interior of the tube with a liquid to be consumed through the straw, the filler cap including a plug with an outwardly extending radial projection adapted to be received within a mating annular recess associated with the aperture of the plug.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for storing and dispensing fluids for use by an athlete which have all the advantages of the prior art devices of a large number of designs and configurations for storing liquid for one purpose or another and none of the disadvantages.

It is another object of the present invention to provide a new and improved apparatus for storing and dispensing fluids for use by an athlete which may be easily and efficiently manufactured and marketed.

It is further object of the present invention to provide a new and improved apparatus for storing and dispensing fluids for use by an athlete which are of durable and reliable constructions.

An even further object of the present invention is to provide a new and improved apparatus for storing and dispensing fluids for use by an athlete which are susceptible of a low cost of manufacture with regard to both materials and labor, and which accordingly are then susceptible of low prices of sale to the consuming public, thereby making such apparatus for storing and dispensing fluids for use by an athlete economically available to the buying public.

Still yet another object of the present invention is to provide a new and improved apparatus for storing and dispensing fluids for use by an athlete which provide in the apparatuses and methods of the prior art some of the advantages thereof, while simultaneously overcoming some of the disadvantages normally associated therewith.

Still another object of the present invention is to store a quantity of fluid for use on the person of an athlete and for dispensing such fluid as needed.

Lastly, it is an object of the present invention to provide new and improved apparatus for storing and dispensing fluids for use by an athlete comprising an elongated hollow tube formed of a flexible material, the tube having closed ends and a hollow interior along its length; a pair of straps secured to and extending outwardly from the free ends with fasteners at the outboard ends of the straps for coupling therebetween and effecting the creation of a loop of the straps and tube; a flexible, plastic straw having an inboard end in fluid communication with the interior of the tube and having an outboard end with a mouthpiece secured with respect thereto, clips secured to the exterior surface of the tube for removably receiving the straw to hold it in position adjacent to the tube; and an aperture on an upper surface of the tube with a filler plug removably received thereover to allow filling of the interior of the tube with a liquid to be consumed through the straw.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the apparatus for storing and dispensing fluids for use by an athlete constructed in accordance with the principles of the present invention.

FIG. 2 is a rear elevational view of the device shown in FIG. 1.

The same reference numerals refer to the same parts through the various Figures.

DESCRIPTION OF THE PREFERRED EMBODIMENT

Figure 3:
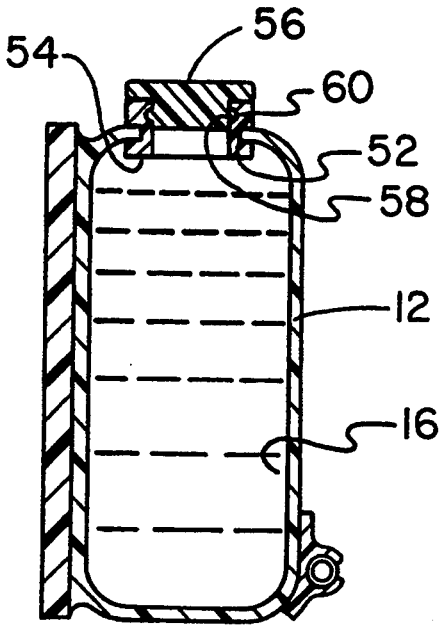
FIG. 3 is a cross sectional view taken along line 3—3 of FIG. 2.
Figure 4:
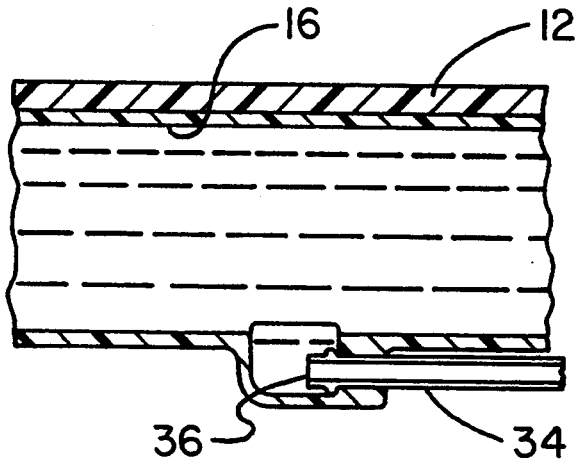
FIG. 4 is a cross sectional view taken along the length of the device shown in the prior Figures.
Figure 5:
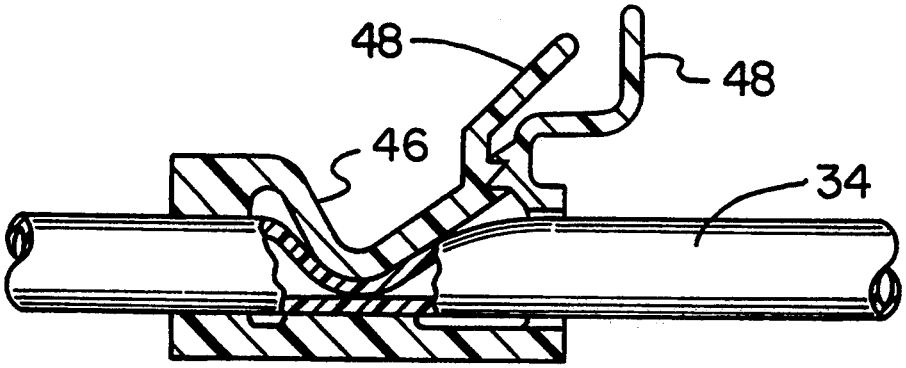
FIG. 5 is an enlarged side elevational view, partly in section, of the clip illustrated in FIGS. 1 and 2.
Figure 6:
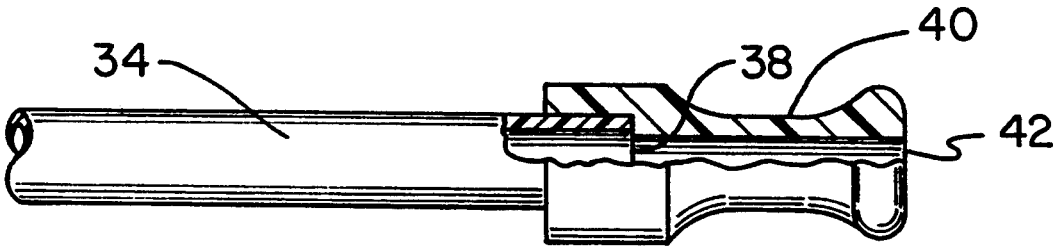
FIG. 6 is a side elevational view of the end of the flexible straw, partly in section, as illustrated in FIGS. 1 and 2.

With reference now to the drawings, and in particular to FIG. 1 thereof, the preferred embodiment of the new and improved apparatus for storing and dispensing fluids for use by an athlete embodying the principles and concepts of the present invention and generally designated by the reference numeral 10 will be described.

The present invention, the new and improved apparatus for storing and dispensing fluids for use by an athlete is comprised of a plurality of component elements. Such component elements in their broadest context, include hollow tube, a pair of straps, vertical straps, plastic straw, valve and aperture. Such components are individually configured and correlated with respect to each other so as to attain the desired objectives.

The central component of the system 10 of the present invention is an elongated hollow tube 12. Such tube is formed of a fluid impervious material, a flexible plastic material is preferred. The tube has closed ends 14. It also has a hollow interior 16 along its length between the closed end.

Secured to and extending outwardly from the free ends of the tube are a pair of straps 20. The straps are formed with pile type fasteners 22 at the free ends at the outboard ends of the strap. Such fasteners are for coupling one to another. When coupled they will effect the creation of a loop of the strap and the tube. Note FIG. 1.

Next provided are a pair of vertical straps 26. Each such strap extends upwardly from an interior surface 28 of the tube at diametrically opposed locations. Fasteners 30, preferably of the pile type, are secured to the upper ends of such vertical straps. Such fasteners are for removable coupling therebetween during operation and use at which time they are positioned on the device such as the helmet worn by an athlete.

The next component of the system is a flexible, plastic straw 34. Such straw again is preferably fabricated of a liquid impervious material. The straw has an inboard end 36. The inboard end is in fluid communication with the interior of the tube. The straw also has an outboard end 38. Located on the outboard is a mouthpiece 40, preferably of a plastic material, with an opening 42 therethrough. The mouthpiece is removably secured with respect to the outboard end of the straw. It is removably received at such location to hold it in position adjacent to the tube.

The next component of the system is an on/off valve 46. Such valve is positioned at an intermediate location along the length of the straw. The valve functions for sealing the straw for preclude removal of liquid from interior of the tube. When the ends 48 of the valve are separated by the user, it will allow liquid to flow from interior of the tube and through the straw and through the mouthpiece for being consumed by the user.

The last component of the system 10 is an aperture 52 on the upper surface of the tube at an intermediate location. The aperture includes a filler plug 54. Such plug is removably received over the aperture to allow filling of the interior of the tube with a liquid to be consumed through the straw. The filler cap includes a plug 56 with an outwardly extending radial projection 58. Such projection is adapted to be sealingly received within a mating annular recess 60. The recess is formed in the interior surface of the aperture of the plug.

The present invention holds about two glasses of water, readily available for sipping through a straw. It is designed for use by athletes and sports minded people, with great care taken in the design to ensure that it offers a minimum of inconvenience during activities. Best results are obtained when it is attached to a cap or helmet. Its presence is unnoticeable because the total weight, including the water, is very small. However, to a parched bicyclist, the water is often enough to carry them through the torturous conditions imposed by hills, distance, temperatures, and competition.

The water is stored in a pack which resembles a headband, being only about 2 inches wide and 8 inches long, with straps that project out for 5 inches on each end. Straps also extend up to pass over the top to fit over the skull. The straps can be fastened directly onto a hat or helmet, and are constructed of a durable VELCRO for easy attachment. The outer surface of the pack is also covered with plastic which will adhere to most materials to keep it from sagging during the activities.

A very convenient feature of the present invention is the provision for a drinking straw which fits into an opening into the water chamber. The straw can extend down along the side so it can be thrust into the mouth whenever a sip is needed. A tiny shutoff valve is available to control the flow. All components are made of plastic, so the unit is easy to clean and will not mildew.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved apparatus for storing and dispensing fluids for use by an athlete comprising, in combination:

an elongated hollow tube formed of a flexible, plastic material, the tube having closed ends and a hollow interior along its length;

a pair of straps secured to and extending outwardly from the free ends with pile type fasteners at the outboard ends of the straps for coupling therebetween and effecting the creation of a loop of the straps and tube;

a pair of vertical straps each extending upwardly from an interior surface of the tube at diametrically opposed locations with pile type fasteners secured to the upper ends thereof for removable coupling therebetween during the positioning of the device as on the helmet of an athlete;

a flexible, plastic straw having an inboard end in fluid communication with the interior of the tube and having an outboard end with a plastic mouthpiece removably secured with respect thereto, clips secured to the exterior surface of the tube for removably receiving the straw to hold it in position adjacent to the tube;

an on/off valve positioned at an intermediate location of the straw for sealing the straw to preclude removal of liquid from interior of the tube to and through the mouthpiece; and an aperture on an upper surface of the tube with a filler plug removably received thereover to allow filling of the interior of the tube with a liquid to be consumed through the straw, the filler cap including a plug with an outwardly extending radial projection adapted to be received within a mating annular recess associated with the aperture of the plug.

2. An apparatus for storing and dispensing fluids for use by an athlete comprising:

an elongated hollow tube formed of a flexible materials, the tube having closed ends and a hollow interior along its length;

a pair of straps secured to and extending outwardly from the free ends with fasteners at the outboard ends of the straps for coupling therebetween and effecting the creation of a loop of the straps and tube;

a flexible, plastic straw having an inboard end in fluid communication with the interior of the tube and having an outboard end with a mouthpiece secured with respect thereto, clips secured to the exterior surface of the tube for removably receiving the straw to hold it in position adjacent to the tube;

an aperture on an upper surface of the tube with a filler plug removably received thereover to allow filling of the interior of the tube with a liquid to be consumed through the straw; and a pair of vertical straps each extending upwardly from an interior surface of the tube at diametrically opposed locations with pile type fasteners secured to the upper ends thereof for removable coupling therebetween during the positioning of the device as on the helmet of an athlete.

* * * * *